US007322056B2

(12) United States Patent
Cloward

(10) Patent No.: US 7,322,056 B2
(45) Date of Patent: Jan. 29, 2008

(54) ADULT BED

(76) Inventor: Davis L. Cloward, 307 N. Holden Rd., Greensboro, NC (US) 27410

( * ) Notice: Subject to any disclaimer, the term of this patent is extended or adjusted under 35 U.S.C. 154(b) by 0 days.

(21) Appl. No.: 11/521,569

(22) Filed: Sep. 14, 2006

(65) Prior Publication Data

US 2007/0169263 A1 Jul. 26, 2007

Related U.S. Application Data

(63) Continuation-in-part of application No. 11/339,596, filed on Jan. 25, 2006.

(51) Int. Cl.
*A47C 31/00* (2006.01)

(52) U.S. Cl. ..... 5/414; 5/929

(58) Field of Classification Search ..... 5/414–416, 5/929, 658, 907; 135/96, 121, 157, 161
See application file for complete search history.

(56) References Cited

U.S. PATENT DOCUMENTS

| | | | | | |
|---|---|---|---|---|---|
| 117,370 | A | * | 7/1871 | Bates et al. | 135/121 |
| 130,163 | A | * | 8/1872 | Stoltz | 135/121 |
| 259,337 | A | * | 6/1882 | Smith | 135/161 |
| 325,464 | A | * | 9/1885 | Watson | 135/96 |
| 356,015 | A | * | 1/1887 | Steinberg | 135/154 |
| 372,570 | A | * | 11/1887 | Segar | 135/157 |
| 654,156 | A | * | 7/1900 | Johnson | 135/90 |
| 671,912 | A | * | 4/1901 | Woodward | 135/90 |
| 677,672 | A | | 7/1901 | Libby | |
| 699,835 | A | * | 5/1902 | Chorlton | 5/113 |
| 739,352 | A | | 9/1903 | Schuette | |
| 785,571 | A | | 3/1905 | Raines et al. | |
| 875,206 | A | * | 12/1907 | Osborne | 135/157 |
| 1,021,930 | A | * | 4/1912 | Jackson | 135/121 |
| 1,254,529 | A | * | 1/1918 | Panganiban | 135/121 |
| 1,495,988 | A | * | 6/1924 | Catino | 5/96 |
| 1,737,664 | A | * | 12/1929 | Maness | 135/142 |
| 2,690,186 | A | * | 9/1954 | Ball | 5/415 |
| 3,237,217 | A | | 3/1966 | Desneux | 5/362 |
| 3,311,118 | A | | 3/1967 | Gunter | 135/5.2 |
| 3,668,722 | A | | 6/1972 | Gallant | 5/327 |
| 3,741,225 | A | | 6/1973 | Gunter | 135/5.2 |
| 3,855,652 | A | | 12/1974 | Nicholson | 5/327 |
| 3,971,592 | A | | 7/1976 | Farley | 297/217 |
| 4,069,527 | A | * | 1/1978 | Harris | 5/414 |
| 4,099,773 | A | | 7/1978 | Chang | 297/270 |
| 4,122,567 | A | | 10/1978 | Hanson | 5/345 |
| D256,526 | S | * | 8/1980 | Johnson | D6/389 |
| 4,373,222 | A | | 2/1983 | Wolfe et al. | 5/431 |
| 4,571,761 | A | | 2/1986 | Perlin | 5/431 |
| 4,641,387 | A | | 2/1987 | Bondy et al. | 5/508 |
| 4,779,294 | A | * | 10/1988 | Miller | 135/121 |
| 4,782,541 | A | | 11/1988 | Tuchman | 5/414 |
| 4,825,855 | A | | 5/1989 | Kundson, Jr. | 128/79 |
| 4,884,842 | A | | 12/1989 | Finkelstein | 297/331 |
| 4,958,391 | A | | 9/1990 | Egeland | 5/127 |
| 4,965,895 | A | | 10/1990 | Shuston | 5/414 |

(Continued)

*Primary Examiner*—Robert G. Santos
(74) *Attorney, Agent, or Firm*—MacCord Mason PLLC

(57) ABSTRACT

An over-bed structure for a bed a bed including such a structure provides a plurality of members in a predominantly horizontal array supported on bed corner posts at a height above the mattress height. The horizontal array of members may be used as supports by persons engaged in sexual activity on the bed.

7 Claims, 8 Drawing Sheets

U.S. PATENT DOCUMENTS

| | | | | |
|---|---|---|---|---|
| 5,241,717 | A | 9/1993 | Ward et al. | 5/201 |
| 5,280,794 | A | 1/1994 | Degen | 128/845 |
| 5,384,925 | A * | 1/1995 | Vail | 5/424 |
| 5,453,080 | A | 9/1995 | Mitchum, Jr. | 600/38 |
| 5,507,046 | A * | 4/1996 | Taylor | 5/414 |
| 5,615,424 | A * | 4/1997 | Nakata | 5/2.1 |
| 5,662,132 | A | 9/1997 | Larsen | 135/96 |
| 5,718,254 | A * | 2/1998 | Murphy | 135/96 |
| 5,737,784 | A * | 4/1998 | Jackman | 5/414 |
| 5,782,243 | A | 7/1998 | Bisyak | 128/845 |
| 5,784,732 | A | 7/1998 | Vail | 5/430 |
| 5,875,779 | A | 3/1999 | Furman et al. | 128/845 |
| 5,971,480 | A | 10/1999 | Maschke | 297/273 |
| D417,089 | S | 11/1999 | McDaniel et al. | D6/389 |
| D418,691 | S | 1/2000 | O'Hare | D6/389 |
| 6,030,039 | A | 2/2000 | Essler | 297/273 |
| 6,101,652 | A | 8/2000 | Matern, Jr. | 5/648 |
| 6,199,552 | B1 | 3/2001 | Crespo | 128/845 |
| 6,216,291 | B1 * | 4/2001 | Eads et al. | 5/424 |
| D443,152 | S | 6/2001 | O'Hare et al. | D6/389 |
| 6,263,529 | B1 * | 7/2001 | Chadwick et al. | 5/414 |
| 6,338,344 | B1 | 1/2002 | Sinohui, Jr. | 128/845 |
| 6,487,735 | B1 | 12/2002 | Jacques, II et al. | 5/424 |
| 6,687,930 | B1 * | 2/2004 | Eads et al. | 5/414 |
| 6,694,547 | B1 * | 2/2004 | Vail | 5/424 |
| 6,698,431 | B1 | 3/2004 | Harris et al. | 128/845 |
| 6,715,168 | B2 * | 4/2004 | Williams | 5/414 |
| 6,745,774 | B2 | 6/2004 | Fessler | 128/845 |
| 6,772,458 | B2 * | 8/2004 | Ellen et al. | 5/424 |
| 6,925,669 | B1 | 8/2005 | Friedman et al. | 5/657 |
| 6,926,006 | B2 | 8/2005 | Black | 128/845 |
| 2003/0126686 | A1 | 7/2003 | Nash | 5/657 |
| 2003/0145378 | A1 * | 8/2003 | Williams | 5/113 |
| 2003/0233707 | A1 | 12/2003 | East | 5/613 |
| 2005/0011006 | A1 * | 1/2005 | Ellen et al. | 5/424 |
| 2005/0081296 | A1 | 4/2005 | Dawes | 5/648 |
| 2005/0114995 | A1 * | 6/2005 | Nakata et al. | 5/2.1 |
| 2007/0169263 | A1 * | 7/2007 | Cloward | 5/414 |
| 2007/0169277 | A1 * | 7/2007 | Cloward | 5/929 |

* cited by examiner

ADULT BED

This application is a continuation-in-part application claiming priority to U.S. patent application Ser. No. 11/339,596 filed Jan. 25, 2006.

BACKGROUND (1) Field

This disclosure relates generally to furniture, and, more specifically, to an over-bed structure for a bed and to a bed including such a structure.

(2) Description of Related Art

Although beds having canopies are known, these known canopies are not capable of supporting the weight of an adult during sexual activities. Or, if they are capable of supporting an adult, they are usually obtrusive in the bedroom and so unattractive as to discourage their use. Thus, a bed having a support structure that is at once able to support the weight of a human adult in a comfortable position during sexual activity and an acceptable decorative piece of bedroom furniture is needed.

SUMMARY

This disclosure describes embodiments of an adult bed. The bed may include a base providing a first area for receiving a mattress and retaining the mattress in a substantially fixed position. The bed may further include a framework capable of suspending the weight of an adult human above the first area, the framework comprising members in a second area that is about three and a half feet to about five feet above a top of the first area. Furthermore, the members may be spaced to provide unobstructed openings above the first area, each opening sized adequately to permit an adult human to stand on the first area and extend its torso between the members. In addition, the bed may include a support suspending the framework and capable of suspending the framework with the framework suspending the weight of an adult human.

DESCRIPTION OF THE PREFERRED EMBODIMENTS

Figure 1:
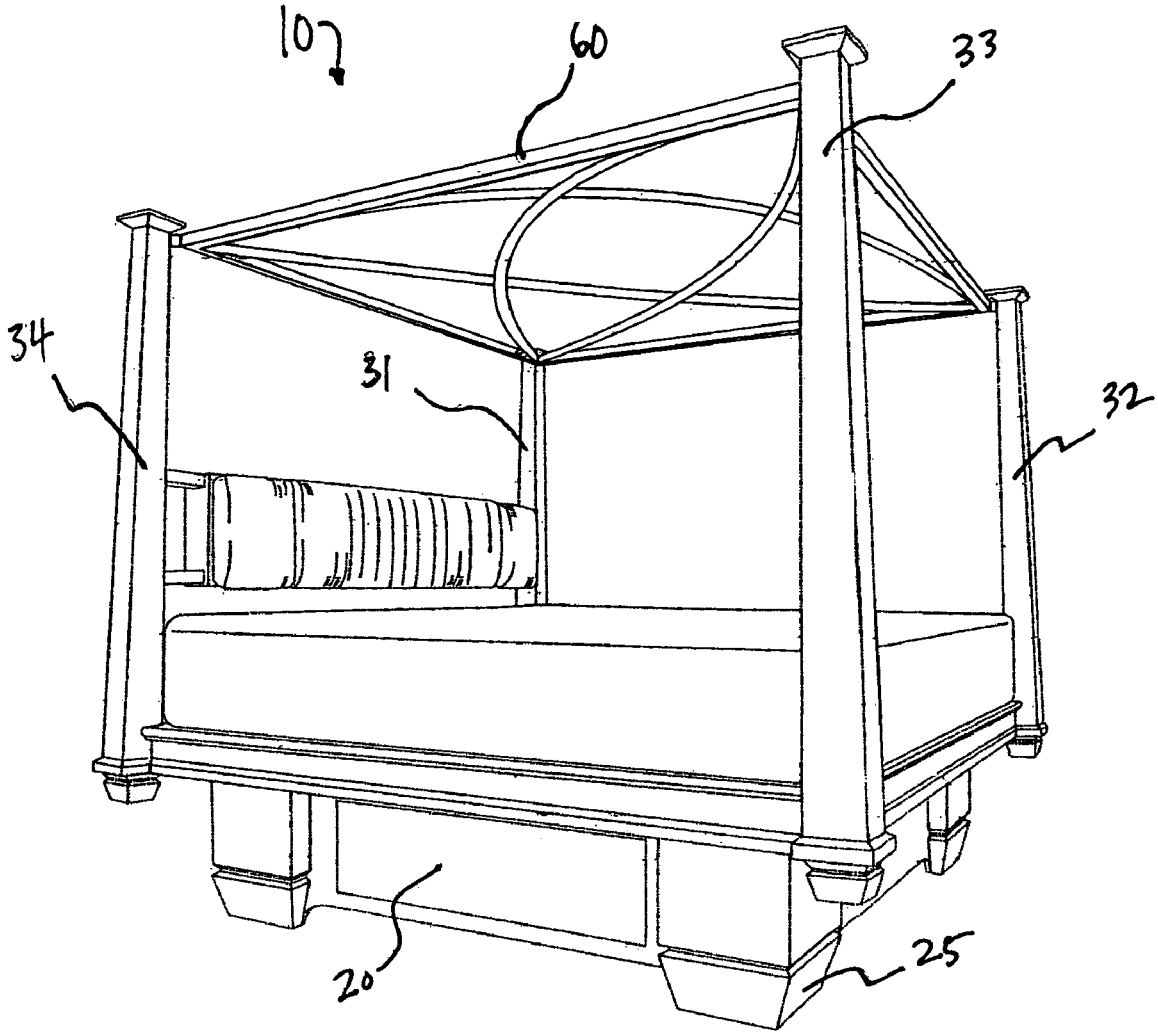
FIG. 1 is a front perspective view of an embodiment of a bed including an over-bed structure.
Figure 2:
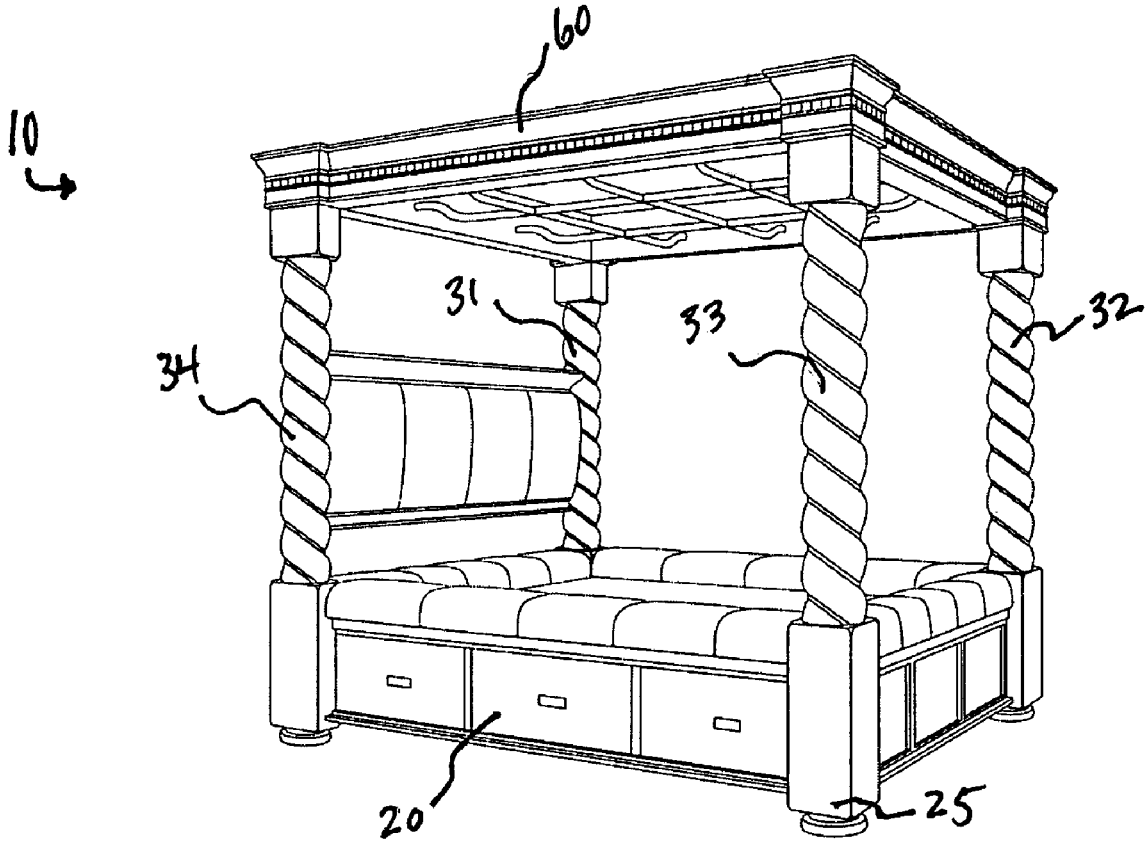
FIG. 2 is a front view of an alternative embodiment of a bed including an over-bed structure.

In the following description, like reference characters designate like or corresponding parts throughout the several views. Also in the following description, it is to be understood that such terms as "forward," "rearward," "left," "right," "upwardly," "downwardly," and the like are words of convenience and are not limiting terms. In addition, while the illustrations and descriptions describe embodiments of an apparatus, the apparatus is not limited to any particular embodiment described or disclosed.

FIGS. 1-5 show embodiments of an adult bed 10. Each bed 10 includes a base 20, one or more supports 31, 32, 33 and 34 extending upwardly and an over-bed structure 60 supported by the supports 31, 32, 33 and 34. The base 20 may include one or more feet, such as the foot 25, that are configured to contact a floor or other substrate at a lower margin of the base 20 that also forms the lower margin of the bed 10. The foot 25 is substantially rigidly connected to the base 20, which is configured to support a mattress that can take the form of a foam cushion, an inflatable air or water container, or any other structure providing a substrate for supporting adults. In addition, although the foot 25 is substantially rigidly connected to the base 20, some vertical adjustability of the foot 25 with respect to the base 20 may be provided for leveling the bed 10, and while the foot 25 is shown as a distinct appendage projecting downwardly to suspend the remainder of the base 20 above a substrate below, the foot 25 can also be, for example, one or more rails defining a lower margin of the base 20. In either case, the base 20 provides a fixed area 40 for the substrate-providing structure.

Figure 3B:
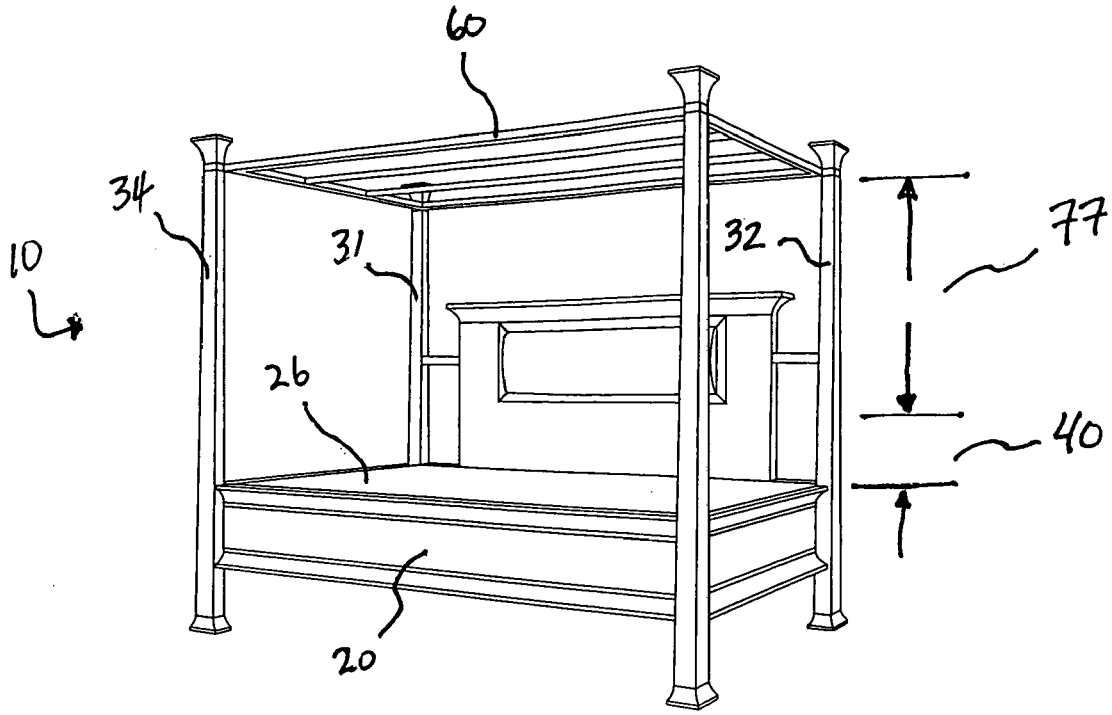
FIG. 3*b* is front view of an alternative embodiment of the bed shown in FIG. 3*a;*
Figure 3A:
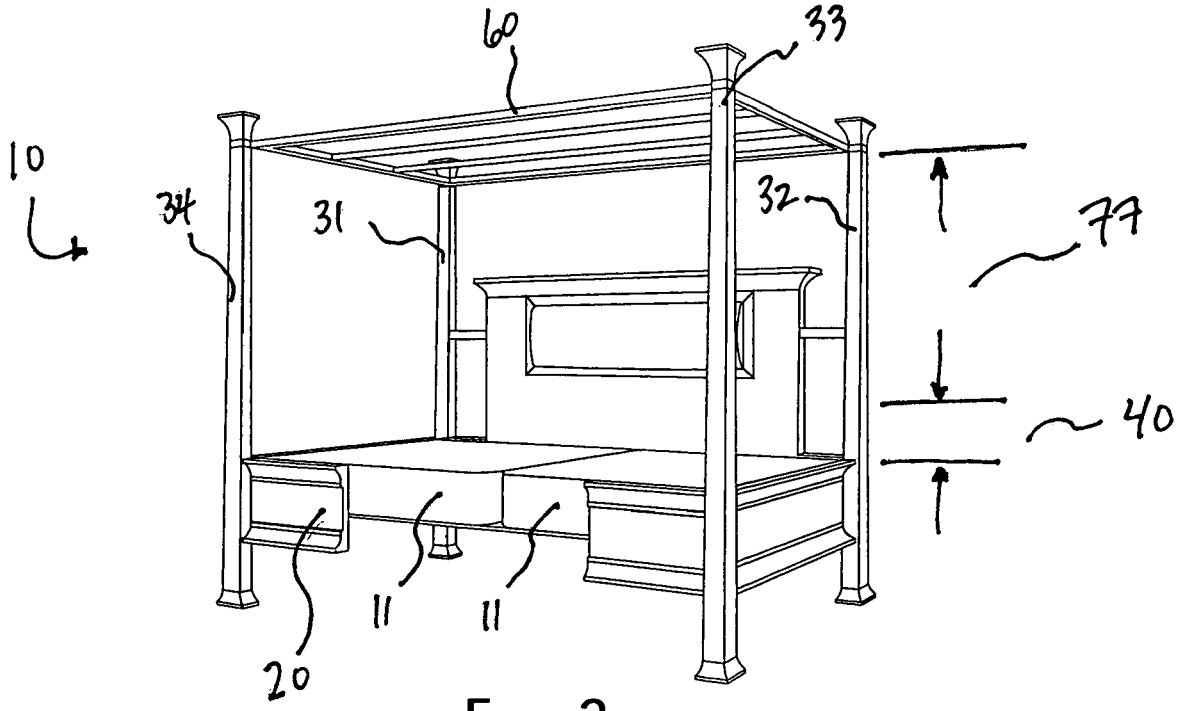
FIG. 3*a* is also a front view of alternative embodiment of a bed including an over-bed structure.
Figure 4:
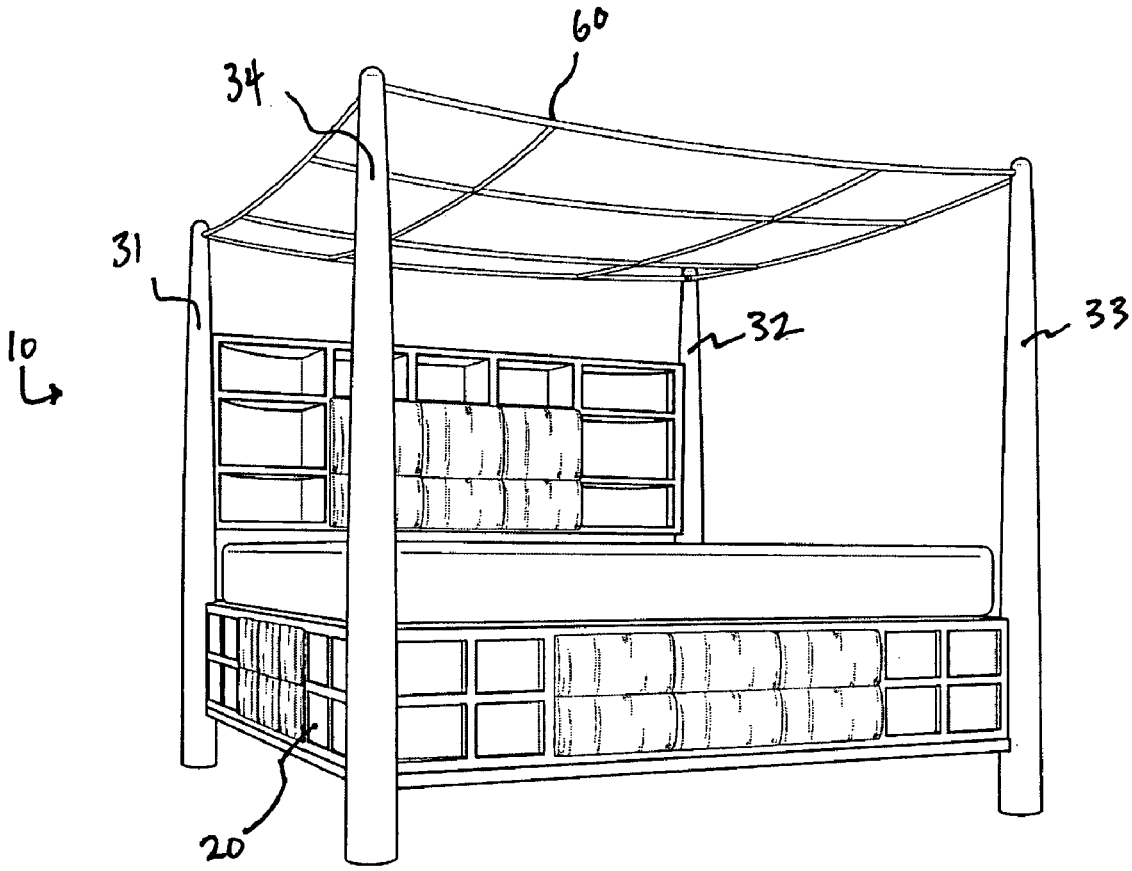
FIG. 4 is a front view of another alternative embodiment of a bed including an over-bed structure.
Figure 5:
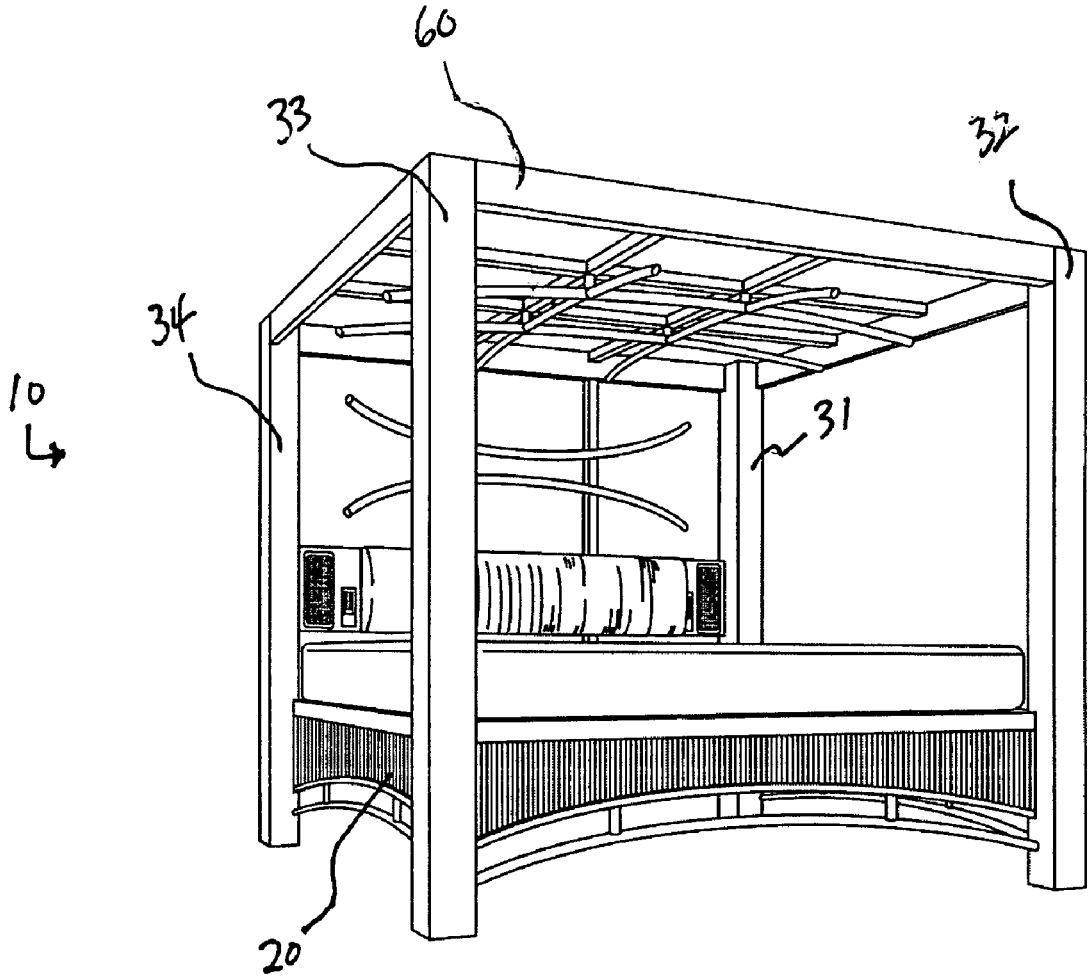
FIG. 5 is a front view of yet another alternative embodiment of a bed including an over-bed structure.
Figure 6:
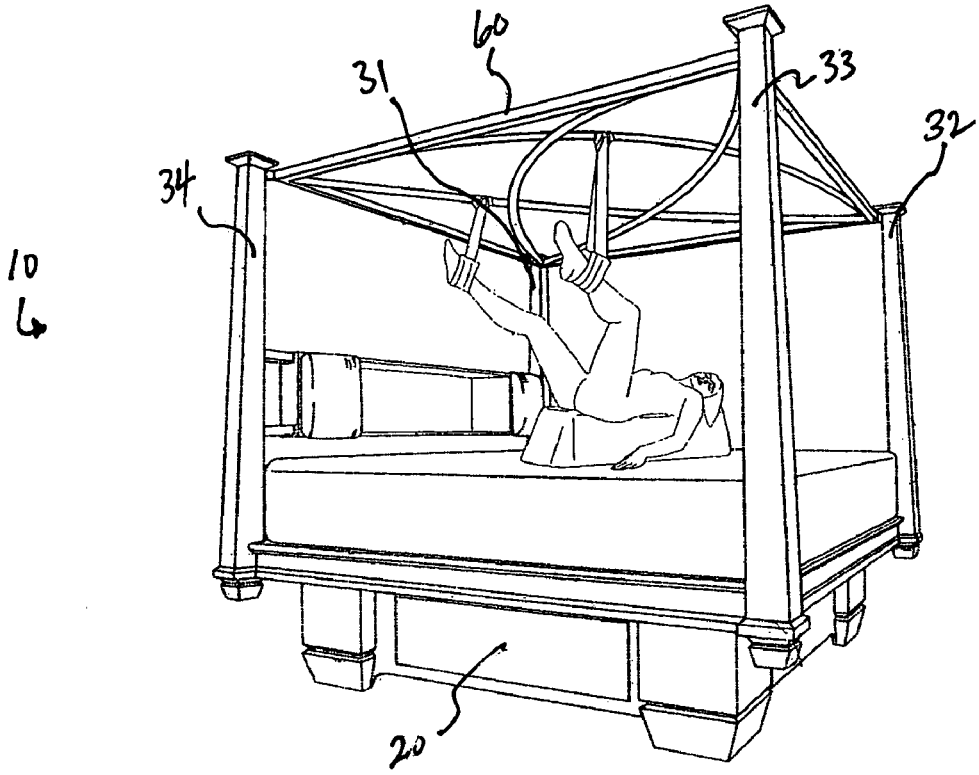
FIG. 6 is a front perspective view of a bed showing adults using the bed.

FIGS. 3*a* and 3*b*, in particular, illustrate the position of the fixed area 40. The area 40 is generally a box that is about the size of the mattress for which the bed is designed. In some embodiments, this fixed area 40 is defined at its bottom by the surface of a support structure for suspending a box spring, or pair of box springs, and thus, the fixed area 40 for the mattress extends vertically from its bottom at a horizontal plane that is about eight inches, assuming the bed is designed to receive a box spring that is about eight inches in vertical dimension from top to bottom surface, above the surface of the support structure to a parallel plane about a foot higher. Where the bed is designed for a mattress without a box spring below, such as, for example, with a platform bed, the bottom of the fixed area 40 may be a plane at the top of a surface 26 of the structure for supporting the mattress, and may extend vertically to another, parallel plane about a foot above, as shown in FIG. 3*b*, assuming the bed is designed to receive a mattress that is about a foot in dimension from its bottom to top surface. Also, although the mattress received by the base 20 may slide a bit horizontally, and perhaps flex downwardly somewhat, the base 20 is configured to contain the structure within a substantially fixed area with respect to a floor below and remainder of the bed 10.

Figure 7:
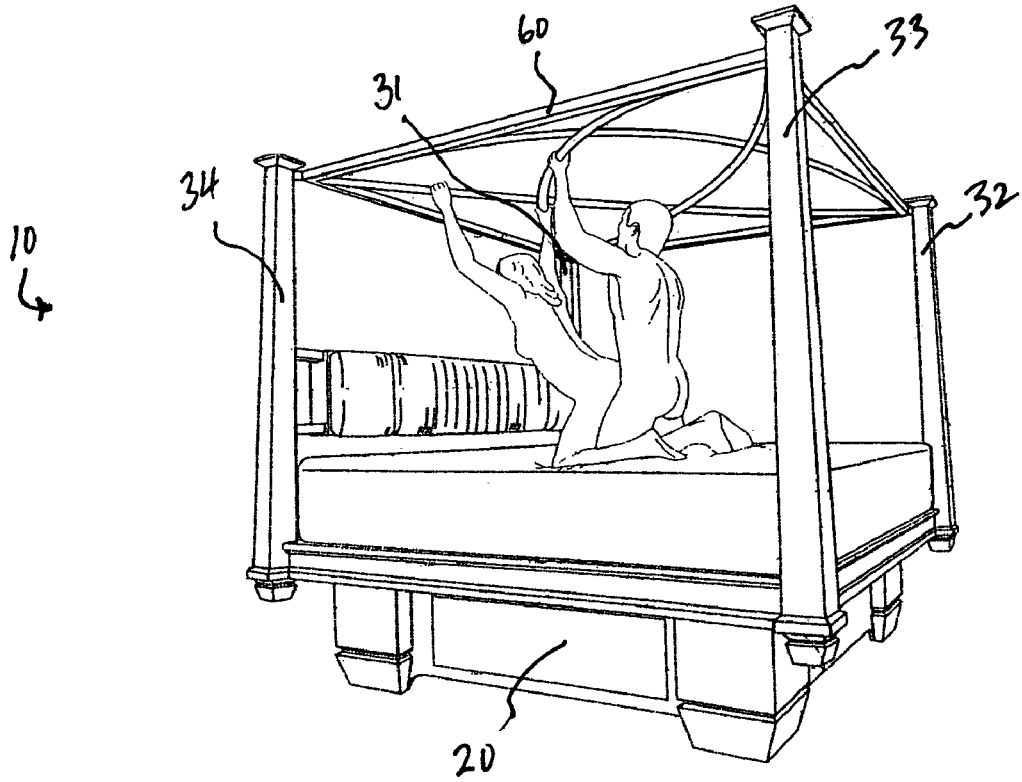
FIG. 7 is also a front perspective view of a bed showing adults using the bed.
Figure 8:
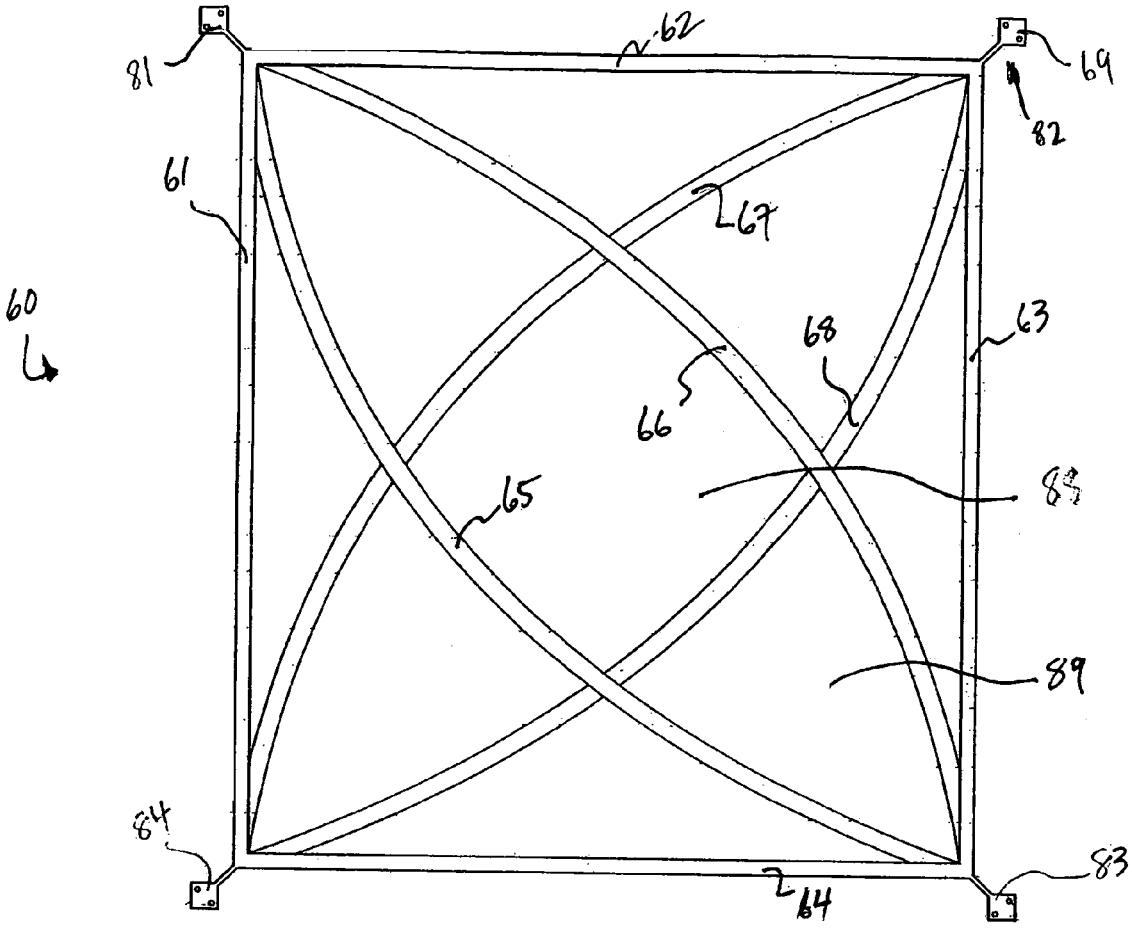
FIG. 8 is a top view of a canopy for a bed.

FIGS. 7 and 8 show an embodiment of the adult bed 10 and adults in various positions on the bed 10. Usually, an adult bed is one that is referred to in the industry as a "king," "California king," "queen," "full," "standard" "double," or may be referenced by other terms having similar meanings. Thus, in this regard, an adult bed is substantially larger than a baby crib or children's bed, and is usually larger than what is often called a "twin" or "single" bed. Note also that while the base 20 is shown herein generally in the shape of a quadrilateral, it can, of course, take various other shapes, including, but not limited to, circular, oval, elliptical, polygonal, or triangular. Similarly, the supports 31, 32, 33 and 34 are shown at four corners of the base 20, but they can, alternatively, be positioned to extend upwardly from a substrate below, with or without being coupled to the base 20. For example, if the base has a circular shape, a support may extend from a central area within the base. No matter their position, the supports 31, 32, 33 and 34 are of a sturdy construction, adequate to support the over-bed structure 60 with the structure 60 partially or wholly suspending the weight of an adult from any part. In this regard, an adult is assumed to weigh at least 200 pounds. Accordingly, the supports 31, 32, 33 and 34 can be of solid or laminated wood construction, or they can include metal, plastic, or virtually any other material formed to meet this requirement, and while they are shown as vertical supports in the figures, they can have a somewhat curved shape, or they can be formed to include any other styling, so long as they are of adequate strength to suspend the structure 60. Similarly, interfaces 31, 32, 33 and 34 between the over-bed structure 60 and the supports 31, 32, 33 and 34 must have a construction sufficient to prevent failure of the bed 10 under the expected load. Additionally, the over-bed structure 60 should be supported by the supports 31, 32, 33 and 34 at a distance 77 from the base 20 that permits an adult to access the structure 60 from a kneeling or sitting position on any adult-supporting structure received by the base 20. Accordingly, the distance 77 is one that provides from about 3½ feet to about 5 feet between the over-bed structure 60 and any adult-supporting structures at the base 20. For example, the bed 10 shown is configured to receive a box spring 11 and mattress atop the box spring 11 such that the top surface of the mattress is generally about four feet from the over-bed structure 60. Thus, since a box spring is usually about eight inches thick from bottom to top surface and a mattress about a foot thick, the base 20 supports the box springs at a level that is generally less than about five foot eight inches from the over-bed structure 60 to provide the desired distance 77 in one embodiment.

Figure 9:
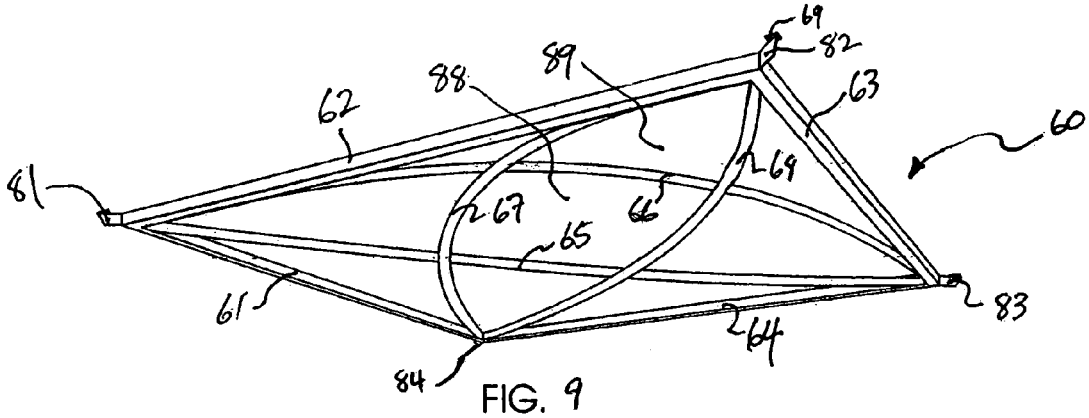
FIG. 9 is a bottom perspective view of the canopy.
Figure 10:
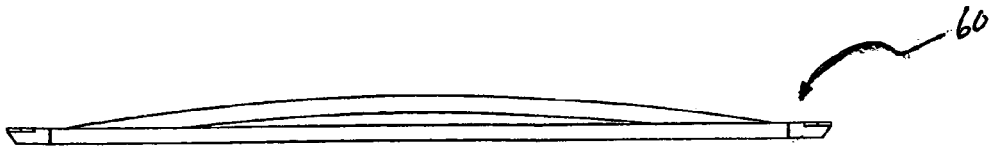
FIG. 10 is side view of the canopy.

FIGS. 8, 9, and 10 show an embodiment of the over-bed structure 60 having a steel construction that includes a peripheral framework with the members 61, 62, 63 and 64 and an interior latticework including the members 65, 66, 67 and 68. In this embodiment of the structure 60, each of the members 61, 62, 63 and 64 is tubular with a square cross section and opposing beveled ends that are each welded to an adjacent member 61, 62, 63 and 64. Each member 65, 66, 67 and 68 of the interior latticework is tubular with a round cross section and is welded at opposing ends to the peripheral frame. Notably, the members 65, 66, 67 and 68 have a round or oval-shaped cross-section, or are otherwise constructed with portions have no angular edges, so that they provide a comfortable surface for grasping. Welded to the four outside corners of the peripheral frame are the projections 81, 82, 83 and 84 which each include a steel plate, such as the plate 69, that can be secured in a slot formed in bedposts with fasteners such as screws, although the particular material from which the structure 60 is formed and the means used to connect the members of the structure 60 to each other and in turn the structure 60 to the remainder of the bed are shown by way of example. Components of the over-bed structure 60 can include wood, or components having a metal core and wood surface layer, or aluminum, iron, or plastic members, or the like. Similarly, fasteners for joining members together and for joining the structure 60 to the remainder of the bed 10 can take any form, so long as the bed 10 is capable of performing its function.

The members 65, 66, 67 and 68 of the interior latticework or framework are positioned in relation to one another and in relation to each other and the members 61, 62, 63 and 64 of the peripheral framework to provide one or more openings, such as the openings 88 and 89, in the structure 60, of sufficient size to permit, when attached to the remainder of a bed 10, an adult to stand on the bed placing his or her torso through one of the openings 88 and 89. In this regard, each opening 88 and 89 provides at least a space in the shape an ellipse having a major axis of at least 22 inches, preferably at least 24 inches, and a minor axis of at least 10 inches, preferably at least 12 inches. That is, the members 65, 66, 67 and 68 themselves may form roughly diamond and triangular shapes, respectively, when viewing the structure 60 from above or below, as in FIG. 8. Yet the roughly diamond and triangular shaped spaces 88 and 89 between the members 65, 66, 67 and 68 are large enough to provide an unobstructed opening at least the size of an ellipse having these dimensions to fit, with axes of the ellipse oriented in generally coplanar relationship with structure 60, between the members 65, 66, 67 and 68. Note also that, as shown particularly in FIG. 10, that the members 65, 66, 67 and 68 may have some upward curvature that places portions of each of them in the area 40 at varying distances from the top surface of the mattress, yet the entirety of each member 65, 66, 67 and 68 may reside in the area that is about 3½ feet to about 5 feet above the top surface of the mattress.

Figure 11:
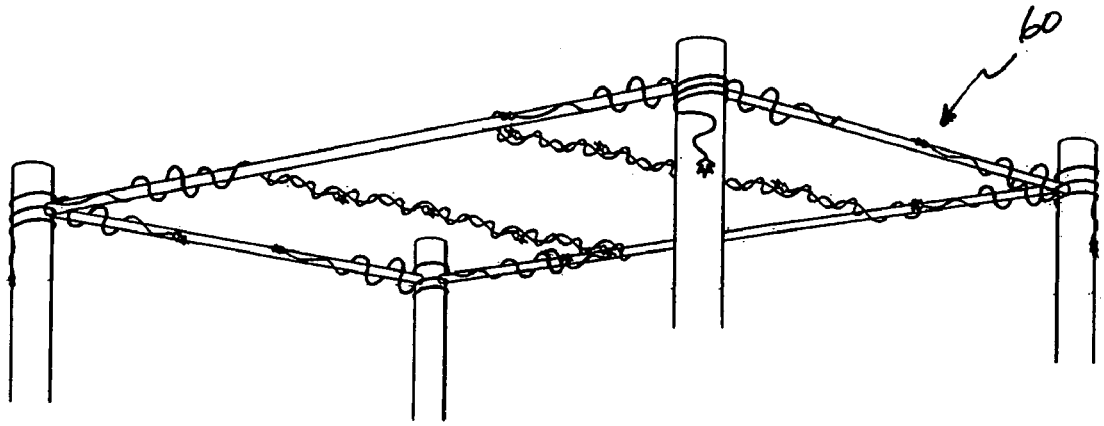
FIG. 11 is bottom perspective view of an alternative embodiment of the canopy.
Figure 12:
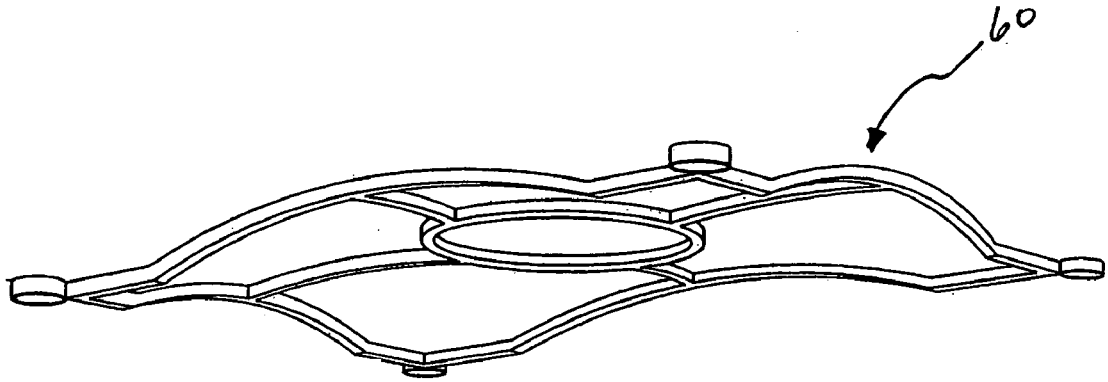
FIG. 12 is also a bottom perspective view of an alternative embodiment of the canopy.

FIGS. 11, 12, and 13 show alternative embodiments of the structure 60. Certain modifications and improvements will occur to those skilled in the art upon a reading of the foregoing description. All such modifications and improvements have not been included herein for the sake of conciseness and readability but may nevertheless properly fall within the scope of the appended claims.

I claim:

1. An adult bed comprising:

a base providing a first area for receiving a mattress and retaining the mattress in a substantially fixed position;

a framework configured and arranged to be capable of suspending the weight of an adult human above the first area, the framework comprising members in a second area that is about three and a half feet to about five feet above a top of the first area, the members spaced to provide unobstructed openings above the first area, each opening sized adequately to permit a 200 pound adult human to stand on the first area and extend his or her torso through the opening between the members; and a support extending upward from the base and connected to the base below the first area for receiving a mattress suspending the framework and configured and arranged to be capable of suspending the framework with the framework suspending the weight of a 200 pound adult human engaging in sexual activity with another adult human without permanent deformation of the support and framework.

2. The bed of claim 1 wherein one of the openings includes unobstructed space in the shape of an ellipse having axes aligned in generally coplanar relationship to the framework and the ellipse has a major axis of at least about 22 inches and a minor axis of at least about 10 inches.

3. The bed of claim 2 wherein one of the unobstructed openings includes a space in the shape of an ellipse having axes oriented in generally coplanar relationship to the framework and the ellipse has a major axis of at least about 24 inches a minor axis of at least about 12 inches.

4. The bed of claim 3 wherein at least one of the members is constructed having a portion without angular edges.

5. A framework for a bed, the framework configured and arranged to be capable of suspending the weight of an adult human above a bed and configured to be attached over the bed to provide openings of sufficient size to permit a 200 pound adult human to stand on the bed and extend his or her torso through openings between members of the framework and support the weight of a 200 pound adult human engaging in sexual activity with another adult human without permanent deformation of the framework, the framework including a plurality of plates extending outward from corners of the framework configured to attach to bedposts.

6. An adult bed comprising:

a base providing a first area for receiving a mattress and retaining the mattress so that the mattress has a top at a first level;

a support connected to the base below the first area for receiving a mattress extending upwardly above the base to a height above the first level; and a framework of members supported by the support;

wherein the members of the framework are spaced about three and a half feet to about five feet above the first level, and the members are spaced apart from one another sufficiently to provide openings in the framework large enough for a 200 pound adult human to stand on the first level and extend his or her torso through the openings between members of the framework; and the support and framework are stout enough to support the weight of a 200 pound adult human suspended from the framework and engaging in sexual activity with another adult human without permanent deformation of the support and framework.

7. An adult bed as claimed in claim 6 wherein there are a plurality of openings and the openings are not congruent with one another.

* * * * *